455-612 AU 233 EX
FIP3106 XR 4,207,561

United States Patent [19] [11] 4,207,561
Steensma [45] Jun. 10, 1980

[54] INTRUDER ALARM ARRANGEMENT FOR AN OPTICAL COMMUNICATION SYSTEM

[75] Inventor: Peter D. Steensma, Midland Park, N.J.

[73] Assignee: International Telephone and Telegraph Corporation, New York, N.Y.

[21] Appl. No.: 627,585

[22] Filed: Oct. 31, 1975

[51] Int. Cl.[2] ..... G08B 21/00
[52] U.S. Cl. ..... 340/600; 340/531; 340/540; 356/73.1; 455/612
[58] Field of Search ..... 340/258 R, 421, 416, 340/220, 600, 531, 540; 250/199; 350/96 WG, 96.10; 356/212, 206, 204, 73.1, 435, 256

[56] References Cited

U.S. PATENT DOCUMENTS

| | | | |
|---|---|---|---|
| 3,134,840 | 5/1964 | Gamo | 250/199 |
| 3,135,951 | 6/1964 | Byrne | 340/258 |
| 3,698,820 | 10/1972 | Hanff et al. | 356/206 |
| 3,717,769 | 2/1973 | Hubbard et al. | 250/199 |
| 3,832,061 | 8/1974 | Smith et al. | 356/206 |

*Primary Examiner*—Glen R. Swann, III
*Attorney, Agent, or Firm*—John T. O'Halloran; Alfred C. Hill

[57] ABSTRACT

An intelligence modulated optical beam is injected into an optical waveguide through a beam splitter. At the output end of the optical waveguide the optical beam has a portion thereof transmitter through a partial reflector to a detector or receiver with a portion of the optical beam at the output of the waveguide being reflected back into the waveguide with the reflected beam being reflected by the beam splitter to a correlator. A replica of the intelligence of the injected optical beam delayed an amount equal to the round trip transit time of the optical beam is supplied as the other input of the correlator. The delayed replica of the intelligence of the optical beam and reflected optical beam are correlated to produce an output from the correlator proportional to the attenuation or intensity of the reflected beam. When the output of the correlator falls below a given value, an alarm is actuated indicating that an intruder has intercepted intelligence of the optical beam transmitted through the waveguide.

10 Claims, 2 Drawing Figures

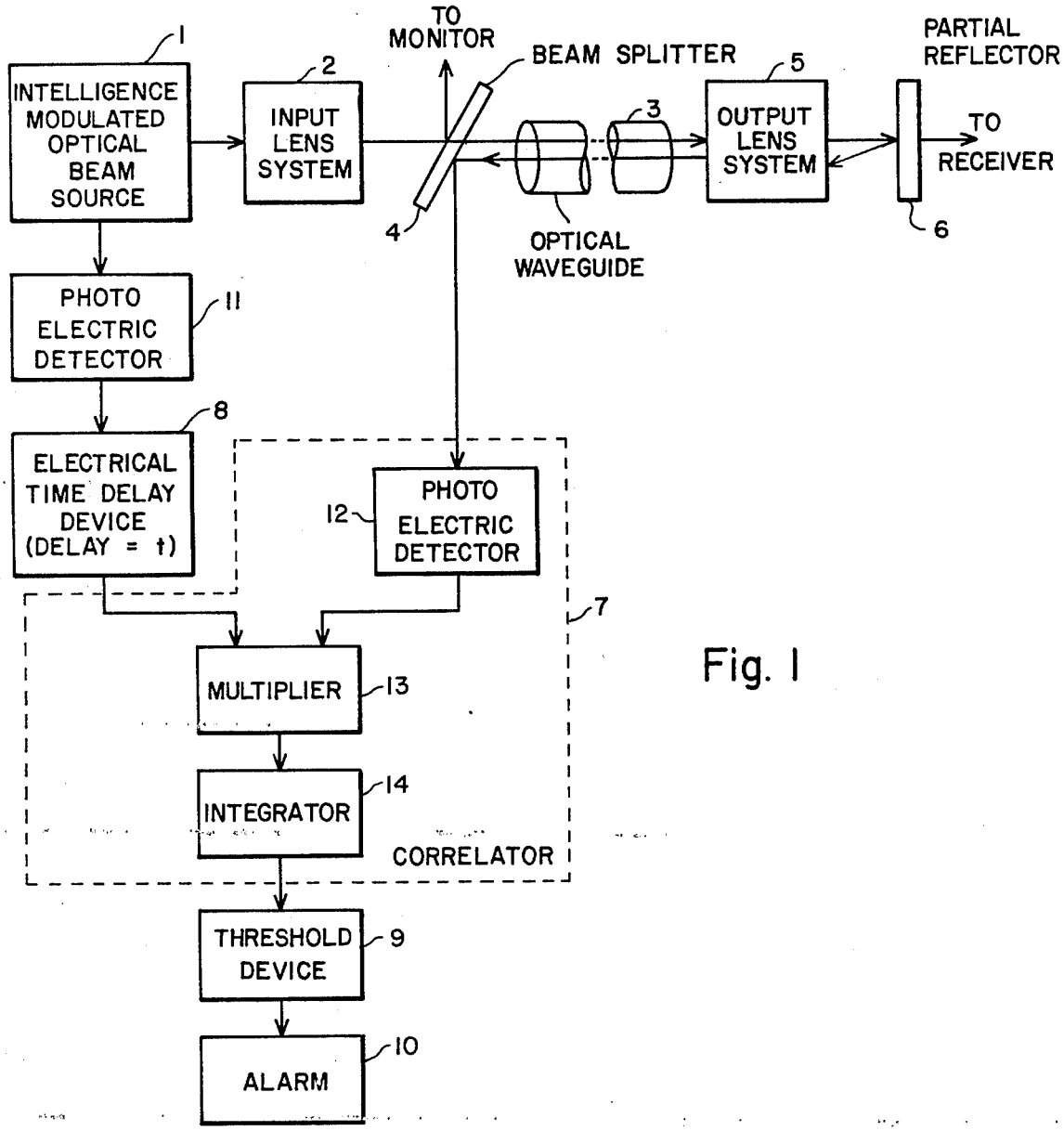
Fig. 1
Fig. 2
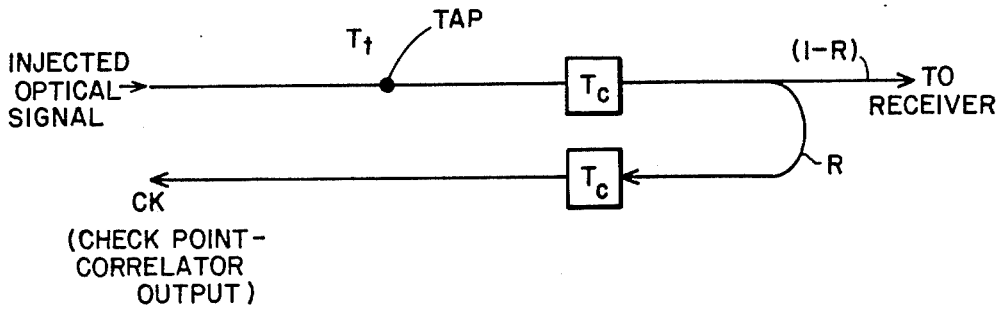

INTRUDER ALARM ARRANGEMENT FOR AN OPTICAL COMMUNICATION SYSTEM

BACKGROUND OF THE INVENTION

This invention relates to optical communication systems.

SUMMARY OF THE INVENTION

An object of the present invention is to provide an alarm arrangement for an optical communication system that will indicate the presence of an intruder in the optical communication system.

A feature of the present invention is the provision of an intruder alarm arrangement for an optical communication system comprising: an optical waveguide; first means disposed adjacent and optically coupled to one end of the waveguide to inject an intelligence modulated optical beam into the one end of the waveguide for transmission to the other end thereof; second means disposed adjacent and optically coupled to the other end of the waveguide to reflect a portion of the beam back into the waveguide for transmission to the one end of the waveguide; and third means disposed adjacent the one end of the waveguide and coupled to the first means and the one end of the waveguide to generate an alarm when the amplitude of the reflected beam falls below a given value.

BRIEF DESCRIPTION OF THE DRAWING

Above-mentioned and other features and objects of this invention will become more apparent by reference to the following description taken in conjunction with the accompanying drawing, in which:

FIG. 1 is a block diagram of an intruder alarm arrangement for an optical communication system in accordance with the principles of the present invention; and FIG. 2 is a schematic diagram useful in defining parameters of the mathematics included herein.

DESCRIPTION OF THE PREFERRED EMBODIMENT

Referring to FIG. 1, there is illustrated therein a block diagram of a simple intruder alarm arrangement based on power conservation for an optical communication system in accordance with the principles of the present invention. An intelligence modulated optical beam source 1 and an input lens system 2 injects the intelligence modulated optical beam into optical waveguide 3 through a beam splitter 4. Source 1 may be implemented by a solid state laser whose optical beam intensity is modulated by an intelligence signal by well known techniques, or by a light emitting diode whose emitted light is intensity modulated by an intelligence signal which varies an operating voltage of the diode. Waveguide 3 may be a single optic fiber or a bundle of a plurality of optic fiber conductors.

A portion of the optical beam is reflected to a monitor by beam splitter 4 and another portion of the optical beam is injected into waveguide 3. The intelligence modulated optical beam at the output of waveguide 3 is passed through an output lens system 5 and, hence, to a partial reflector 6. Reflector 6 will transmit a portion of the intelligence modulated optical beam to a receiver of the communication system and at the same time reflect a portion of the intelligence modulated optical beam at the output of waveguide 3 back into waveguide 3 and, hence, to beam splitter 4. Beam splitter 4 separates the reflected optical beam from the injected optical beam and directs the reflected optical beam to a separate monitor receiver where it can be detected, for example, by correlation in correlator 7 with a delayed replica of the intelligence of the injected light beam with the time delay being provided by electrical time delay device 8 having a time delay t equal to the round trip transit time of the optical beam. If some portion of the optical beam is tapped off by an intruder, the reflected optical beam intensity level will change with respect to the intensity level of the injected optical beam; and when the intensity level of the reflected optical beam is less than a given value, a threshold device 9 having a threshold level equal to the given value is activated to provide an output which actuates alarm 10.

Delay device 8 may be implemented, for example, by a well known acoustic relay line, an-inductor-capacitor delay line, or a magneto-structure delay line.

The electrical intelligence input to device 8 is provided by photo electric detector 11 which may be implemented by a photo electric diode which produces an electrical signal output proportional to the intensity of the optical beam incident thereon.

Correlator 7 may be implemented, for example, by photo electric detector 12 coupled to the reflected optical beam. Photo electric detector 12 may be implemented in the same manner as detector 11. The electrical signal outputs of detectors 12 and delay device 8 are coupled to a multiplier 13 whose output is coupled to an integrator 14 to provide the output signal of correlator 7. As mentioned hereinabove the output signal of integrator 14 is proportional to the amplitude of the intensity of the reflected optical beam and if the amplitude of this output signal falls below a given value the threshold device 9 having a threshold level equal to the given value will be activated for actuation of alarm 10.

Generally the amplitude of the intensity of the reflected optical beam will be quite small and the communication link will be operated with a minimum of excess power injected to some integration time will have to be employed at the correlator, such as provided by integrator 14, to increase the signal to noise ratio presented to the alarm detector, such as threshold device 9. Integration times are determined by the magnitude of the intensity of the reflected optical beam, round trip attenuations, the allowable coupling that will be permitted to an intruder and the allowable false alarm rate. Since an integration time is required, this will limit the system response time and in effect permit an intruder access to however many bits of intelligence pass by the intruder tap on waveguide 3 during the integration time.

Changes in attenuation or intensity that can be resolved by the intruder alarm system of FIG. 1 are determined by the signal-to-noise ratio (S/N) at the correlator output. A change of some noise deviation dN will activate the alarm. Consider the situation illustrated in FIG. 2 where $T_t$ is equal to the time of transmission to the tap, $T_c$ is equal to the time of cable transmission, R is equal to the amplitude of the return reflection and CK is the check point at the correlator output. The power at the tap, $P_{tap}$, is given by the following equation:

$$P_{tap} = T_t P_{in} \quad (1)$$

wherein $P_{in}$ is equal to the power of the injected signal. The power at the receiver, $P_{rcvr}$, is given by the following equation:

$$P_{rcvr}=(1-T_t)T_c(1-R)\,P_{in} \quad (2)$$

The power at the check point, $P_{ck}$, is given by the following equation:

$$P_{ck}=(1-T_t)\,T_c^2\,R\,P_{in} \quad (3)$$

The fluctuation in the power supplied to the check point due to a tap insertion, $\Delta P_{ck}$, is given by the following equation:

$$\Delta P_{ck}=T_c^2 R\,T_t P_{in} \quad (4)$$

If $\Delta P_{ck}$ contains noise and signal $$\Delta P_{ck}=S+N=(dN+1)N \quad (5)$$

for detection. From equation (4)

$$(dN+1)N=T_c^2 R\,T_t\,P_{in} \quad (6)$$

In addition, $T_t$ is given by the following equation:

$$T_t=\frac{(dN+1)\,N}{P_{ck}} \quad (7)$$

Therefore, the detachable tap extraction is determined by the output S/N at the check point. Generally the correlator output will have an $N/P_{ck}$ value decreased by the ratio of the integration time to the instantaneous bandwidth as given by the following equation:

$$\beta=T_{int}B \quad (8)$$

where $\beta$ is equal to the instantaneous bandwidth, $T_{int}$ is equal to the integration time and B is equal to the ratio $\beta/T_{int}$. As a result $$T_t=\left(\frac{dN+1}{\beta}\right)\left(\frac{N}{P_{ck}}\right)=\left(\frac{dN+1}{T_{int}B}\right)\left(\frac{N}{P_{ck}}\right)=\left(\frac{dN+1}{T_{int}B}\right)\left(\frac{R\,T_c^2}{T_t}\right)\left(\frac{N}{P_{tap}}\right) \quad (9)$$

assuming optimum receivers used by all. Consequently, if the tap is operating at a given coupling level $T_t$ and the S/N at the check point is fixed by the reaction time of the alarm, the integration time required can be expressed in terms of the above parameters and the receiver S/N as follows:

$$T_{int}=\frac{(dN+1)\,T_b}{R\,T_c\,T_t}\left(\frac{N}{P_{rcvr}}\right) \quad (10)$$

where $T_b$ is equal to the reaction time of the alarm. The tap S/N is given by the following equation:

$$\frac{P_{tap}}{N}=\frac{T_t}{T_c(1-R)(1-T_t)}\cdot\frac{P_{rcvr}}{N} \quad (11)$$

The accessible information to the intruder, AI, is given by the following equations:

$$AI=(\text{Reaction Time})\,(\text{Transmission Rate})\,(\text{Entropy of Source - Error Rate of Intruder}) \quad (12)$$

For a digital communication system $$AI=\frac{dN+1}{R\,T_cT_t\,(S/N\text{ of Receiver})}\cdot\left(\text{Entropy of Source}-Q\left(\frac{T_t}{T_c(1-R)(1-T_t)}\cdot\frac{P_{rcvr}}{N}\right)\right) \quad (13)$$

where Q is equal to the bits of information that pass the tap.

For a processed digital or analog communication system $$AI=\frac{dN+1}{R\,T_cT_t\,(S/N\text{ of Receiver})}\cdot\left(\text{Entropy of Source}-Q\left(\frac{T_t}{T_c(1-R)(1-T_t)}\cdot\frac{P_{rcvr}}{N}\right)\right)\cdot(\text{Intelligibility})\,\frac{(P_{tap})}{N} \quad (14)$$

While I have described above the principles of my invention in connection with specific apparatus it is to be clearly understood that this description is made only by way of example and not as a limitation to the scope of my invention as set forth in the objects thereof and in the accompanying claims.

I claim:

1. An intruder alarm arrangement for an optical communication system comprising:
   - an optical waveguide;
   - first means disposed adjacent and optically coupled to one end of said waveguide to inject an intelligence modulated optical beam into said one end of said waveguide for transmission to the other end thereof;
   - second means disposed adjacent and optically coupled to said other end of said waveguide to reflect a portion of said beam back into said waveguide for transmission to said one end of said waveguide; and
   - third means disposed adjacent said one end of said waveguide and coupled to said first means and said one end of said waveguide to generate an alarm when the amplitude of said reflected beam falls below a given value.

2. An arrangement according to claim 1, wherein said first means includes
   - a source of said modulated optical beam, and
   - a beam splitter optically coupled between said source and said one end of said waveguide.

3. An arrangement according to claim 2, wherein said second means includes
   - a partial reflector optically coupled to said other end of said waveguide.

4. An arrangement according to claim 3, wherein said third means includes
   - a first photo electric detector coupled to said source producing a first electric signal having an amplitude proportional to the intensity of said injected beam, an electrical time delay device coupled to said first detector to delay said first electirc signal, said delay device having a time delay equal to the round trip transit time of said optical beam, a correlator coupled to said delay device and said beam splitter to produce an output signal proportional to the intensity relation between said injected beam and said reflected beam, and a threshold device having a threshold level equal to said given value coupled to the output of said correlator to produce an alarm when the amplitude of said output signal falls below said threshold level.

5. An arrangement according to claim 4, wherein said correlator includes a second photo electric detector coupled to said beam splitter producing a second electric signal having an amplitude proportional to the intensity of said reflected beam, a multiplier coupled to the output of said delay device and said second detector to multiply said delayed first electric signal by said second electric signal, and an integrator coupled to the output of said multiplier to produce said output signal.

6. An arrangement acccording to claim 1, wherein said second means includes a partial reflector optically coupled to said other end of said waveguide.

7. An arrangement according to claim 6, wherein said third means includes a first photo electric detector coupled to said first means to produce a first electric signal having an amplitude proportional to the intensity of said injected beam, an electrical time delay device coupled to said first detector to delay said first electric signal, said delay device having a time delay equal to the round trip transit time of said optical beam;

a beam splitter optically coupled between said first means and said one end of said waveguide, a correlator coupled to said delay device and said beam splitter to produce an output signal proportional to the intensity relation between said injected beam and said reflected beam, and a threshold device having a threshold level equal to said given value coupled to the output of said correlator to produce an alarm when the amplitude of said output signal falls below said threshold level.

8. An arrangement according to claim 7, wherein said correlator includes a second photo electric detector coupled to said beam splitter producing a second electric signal having an amplitude proportional to the intensity of said reflected beam, a multiplier coupled to the output of said delay device and said second detector to multiply said delayed first electric signal by said second electric signal, and an integrator coupled to the output of said multiplier to produce said output signal.

9. An arrangement according to claim 1, wherein said third means includes a first photo electric detector coupled to said first means to produce a first electric signal having an amplitude proportional to the intensity of said injected beam, an electrical time delay device coupled to said first detector to delay said first electric signal, said delay device having a time delay equal to the round trip transit time of said optical beam, a beam splitter optically coupled between said first means and said one end of said waveguide, a correlator coupled to said delay device and said beam splitter to produce an output signal proportional to the intensity relation between said injected beam and said reflected beam, and a threshold device having a threshold level equal to said given value coupled to the output of said correlator to produce an alarm when the amplitude of said output signal falls below said threshold level.

10. An arrangement according to claim 9, wherein said correlator includes a second photo electric detector coupled to said beam splitter producing a second electric signal having an amplitude proportional to the intensity of said reflected beam, a multiplier coupled to the output of said delay device and said second detector to multiply said delayed first electric signal by said second electric signal, and an integrator coupled to the output of said multiplier to produce said output signal.

* * * * *